US008453746B2

(12) United States Patent
Hailey, Jr. et al.

(10) Patent No.: US 8,453,746 B2
(45) Date of Patent: Jun. 4, 2013

(54) WELL TOOLS WITH ACTUATORS UTILIZING SWELLABLE MATERIALS

(75) Inventors: Travis T. Hailey, Jr., Sugar Land, TX (US); Rune Freyer, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 1181 days.

(21) Appl. No.: 11/407,704

(22) Filed: Apr. 20, 2006

(65) Prior Publication Data

US 2007/0246225 A1 Oct. 25, 2007

(51) Int. Cl.
*E21B 34/06* (2006.01)
*E21B 34/14* (2006.01)

(52) U.S. Cl.
USPC ..... 166/332.8; 166/386

(58) Field of Classification Search
USPC ..... 166/179, 250.1, 332.1, 332.8, 373, 166/386, 387
See application file for complete search history.

(56) References Cited

U.S. PATENT DOCUMENTS

| | | | | |
|---|---|---|---|---|
| 148,387 | A | 3/1874 | Squires | |
| 1,536,348 | A | 5/1925 | Mack | |
| 2,602,516 | A | 7/1952 | Gray | |
| 2,762,437 | A | 9/1956 | Egan et al. | |
| 2,809,654 | A * | 10/1957 | Kraft | 137/197 |
| 2,849,070 | A | 8/1958 | Maly | |
| 2,945,541 | A | 7/1960 | Maly | |
| 2,981,332 | A | 4/1961 | Miller | |
| 2,981,333 | A | 4/1961 | Miller | |
| 3,385,367 | A | 5/1968 | Kollsman | |
| 3,477,506 | A | 11/1969 | Malone | |
| 3,845,818 | A * | 11/1974 | Deaton | 166/322 |
| 4,234,197 | A | 11/1980 | Amancharla | |
| 4,287,952 | A | 9/1981 | Erbstoesser | |
| 4,307,204 | A | 12/1981 | Vidal | |
| 4,375,240 | A | 3/1983 | Baugh et al. | |
| 4,491,186 | A | 1/1985 | Alder | |
| 4,813,218 | A | 3/1989 | Claesson | |
| 4,974,674 | A | 12/1990 | Wells | |
| 4,998,585 | A | 3/1991 | Newcomer | |
| 5,273,066 | A * | 12/1993 | Graham et al. | 137/78.3 |

(Continued)

FOREIGN PATENT DOCUMENTS

| | | |
|---|---|---|
| GB | 2314866 | 1/1998 |
| GB | 2356879 | 6/2001 |

(Continued)

OTHER PUBLICATIONS

Weatherford Product Brochure, "Application Answers" dated 2005.

(Continued)

*Primary Examiner* — Daniel P Stephenson
(74) *Attorney, Agent, or Firm* — Smith IP Services, P.C.

(57) ABSTRACT

Well tools utilizing swellable materials. Actuators for well tools may incorporate swellable materials as force generating devices. A well tool includes an actuator which actuates the well tool in response to contact between a swellable material and a well fluid. A method of actuating a well tool includes the steps of: installing a well tool including an actuator; contacting a swellable material of the actuator with a well fluid; and actuating the well tool in response to the contacting step. A well system includes a well tool with a flow control device and a swellable material. The well tool is operative to control flow through a passage of a tubular string in response to contact between the swellable material and well fluid.

4 Claims, 6 Drawing Sheets

U.S. PATENT DOCUMENTS

| | | | | |
|---|---|---|---|---|
| 5,333,684 | A | 8/1994 | Walter | |
| 5,337,808 | A | 8/1994 | Graham | |
| 5,337,821 | A | 8/1994 | Peterson | |
| 5,433,269 | A | 7/1995 | Hendrickson | |
| 5,435,393 | A | 7/1995 | Brekke | |
| 5,673,751 | A | 10/1997 | Head | |
| 5,730,223 | A | 3/1998 | Restarick | |
| 5,803,179 | A | 9/1998 | Echols | |
| 5,896,928 | A | 4/1999 | Coon | |
| 5,906,238 | A | 5/1999 | Carmody et al. | |
| 6,009,951 | A | 1/2000 | Coronado et al. | |
| 6,112,815 | A | 9/2000 | Boe | |
| 6,112,817 | A | 9/2000 | Voll | |
| 6,227,299 | B1 * | 5/2001 | Dennistoun | 166/332.8 |
| 6,253,861 | B1 | 7/2001 | Carmichael | |
| 6,305,470 | B1 | 10/2001 | Woie | |
| 6,318,729 | B1 | 11/2001 | Pitts, Jr. et al. | |
| 6,343,651 | B1 | 2/2002 | Bixenman | |
| 6,354,378 | B1 | 3/2002 | Patel | |
| 6,371,210 | B1 | 4/2002 | Bode et al. | |
| 6,390,199 | B1 | 5/2002 | Heijnen | |
| 6,431,282 | B1 | 8/2002 | Bosma | |
| 6,478,091 | B1 | 11/2002 | Gano | |
| 6,505,682 | B2 | 1/2003 | Brockman | |
| 6,516,888 | B1 | 2/2003 | Gunnarson | |
| 6,622,794 | B2 | 9/2003 | Zisk | |
| 6,644,412 | B2 | 11/2003 | Bode | |
| 6,679,324 | B2 | 1/2004 | Den Boer | |
| 6,695,067 | B2 | 2/2004 | Johnson | |
| 6,705,615 | B2 | 3/2004 | Milberger et al. | |
| 6,719,051 | B2 | 4/2004 | Hailey | |
| 6,786,285 | B2 | 9/2004 | Johnson | |
| 6,817,416 | B2 | 11/2004 | Wilson | |
| 6,834,725 | B2 | 12/2004 | Whanger | |
| 6,851,560 | B2 | 2/2005 | Reig | |
| 6,857,475 | B2 | 2/2005 | Johnson | |
| 6,857,476 | B2 | 2/2005 | Richards | |
| 6,883,613 | B2 | 4/2005 | Bode | |
| 6,886,634 | B2 | 5/2005 | Richards | |
| 6,907,937 | B2 | 6/2005 | Whanger | |
| 6,957,703 | B2 * | 10/2005 | Trott et al. | 166/332.8 |
| 7,013,979 | B2 | 3/2006 | Richard | |
| 7,059,401 | B2 | 6/2006 | Bode | |
| 7,063,162 | B2 | 6/2006 | Daling | |
| 7,083,162 | B2 | 8/2006 | He | |
| 7,096,945 | B2 | 8/2006 | Richards et al. | |
| 7,100,686 | B2 | 9/2006 | Wittrisch | |
| 7,108,083 | B2 | 9/2006 | Simonds et al. | |
| 7,185,706 | B2 | 3/2007 | Freyer | |
| 7,191,833 | B2 | 3/2007 | Richards | |
| 7,207,386 | B2 | 4/2007 | Brannon | |
| 7,215,594 | B2 | 5/2007 | Im | |
| 7,252,153 | B2 | 8/2007 | Hejl | |
| 7,290,606 | B2 | 11/2007 | Coronado | |
| 7,296,597 | B1 | 11/2007 | Freyer | |
| 7,367,395 | B2 | 5/2008 | Vidrine | |
| 7,426,962 | B2 | 9/2008 | Moen | |
| 7,537,056 | B2 | 5/2009 | MacDougall | |
| 7,690,437 | B2 | 4/2010 | Guillot et al. | |
| 8,037,940 | B2 | 10/2011 | Patel et al. | |
| 2002/0056553 | A1 | 5/2002 | Duhon | |
| 2002/0108755 | A1 | 8/2002 | Zisk | |
| 2004/0020662 | A1 | 2/2004 | Freyer | |
| 2004/0035590 | A1 | 2/2004 | Richard | |
| 2004/0055760 | A1 | 3/2004 | Nguyen | |
| 2004/0060706 | A1 | 4/2004 | Stephenson | |
| 2004/0108107 | A1 | 6/2004 | Wittrisch | |
| 2004/0112609 | A1 | 6/2004 | Whanger | |
| 2004/0144544 | A1 | 7/2004 | Freyer | |
| 2005/0016732 | A1 | 1/2005 | Brannon | |
| 2005/0072576 | A1 | 4/2005 | Henriksen et al. | |
| 2005/0103497 | A1 | 5/2005 | Gondouin | |
| 2005/0110217 | A1 | 5/2005 | Wood | |
| 2005/0171248 | A1 | 8/2005 | Li et al. | |
| 2005/0173130 | A1 | 8/2005 | Richard | |
| 2005/0199401 | A1 | 9/2005 | Patel et al. | |
| 2006/0027377 | A1 | 2/2006 | Schoonderbeek et al. | |
| 2006/0076150 | A1 | 4/2006 | Coronado | |
| 2006/0113089 | A1 | 6/2006 | Henriksen | |
| 2006/0118296 | A1 | 6/2006 | Dybevik | |
| 2006/0175065 | A1 * | 8/2006 | Ross | 166/386 |
| 2006/0185849 | A1 | 8/2006 | Edwards | |
| 2006/0272806 | A1 | 12/2006 | Wilkie et al. | |
| 2007/0151724 | A1 | 7/2007 | Ohmer et al. | |
| 2007/0246210 | A1 | 10/2007 | Richards | |
| 2007/0246212 | A1 | 10/2007 | Richards | |
| 2007/0246213 | A1 * | 10/2007 | Hailey, Jr. | 166/278 |
| 2007/0246407 | A1 | 10/2007 | Richards et al. | |
| 2008/0035330 | A1 | 2/2008 | Richards | |
| 2008/0041580 | A1 | 2/2008 | Freyer | |
| 2008/0041581 | A1 | 2/2008 | Richards | |
| 2008/0041582 | A1 | 2/2008 | Saetre | |
| 2008/0041588 | A1 | 2/2008 | Richards et al. | |
| 2008/0066912 | A1 | 3/2008 | Freyer | |
| 2009/0133869 | A1 | 5/2009 | Clem | |
| 2009/0151925 | A1 | 6/2009 | Richards et al. | |

FOREIGN PATENT DOCUMENTS

| | | | |
|---|---|---|---|
| GB | 2371578 | | 7/2002 |
| GB | 2341405 | | 3/2006 |
| RU | 2157440 | C2 | 10/2000 |
| WO | 0259452 | A1 | 8/2001 |
| WO | 02059452 | A1 | 8/2002 |
| WO | 02075110 | | 9/2002 |
| WO | 02090714 | A1 | 11/2002 |
| WO | 2004057715 | | 7/2004 |
| WO | 2005090741 | A1 | 9/2005 |
| WO | 2005116394 | | 12/2005 |
| WO | 2006003112 | | 1/2006 |
| WO | 2006003113 | | 1/2006 |
| WO | 2007126496 | A2 | 11/2007 |
| WO | 2008024645 | A2 | 2/2008 |
| WO | 2008024645 | A3 | 2/2008 |
| WO | 2009048822 | A2 | 4/2009 |
| WO | 2009048823 | A2 | 4/2009 |
| WO | 2009067021 | A2 | 5/2009 |

OTHER PUBLICATIONS

Office Action for U.S. Appl. No. 10/477,440 dated Jun. 14, 2006.

International Search Report for PCT/NO02/00158.

Examination report for GB 0707831.4 dated Jul. 16, 2007.

Office Action issued for USSN 11/668,024 dated Jan. 11, 2008 (18 pages).

Office Action dated Aug. 26, 2008, for U.S. Appl. No. 11/466,022 (8 pages).

Office Action dated Jul. 10, 2008, for U.S. Appl. No. 11/668,024 (7 pages).

International Search Report and Written Opinion issued for International Application No. PCT/US07/75743 dated Feb. 11, 2008 (8 pages).

International Search Report and Written Opinion issued for International Patent Application No. PCT/US07/61703 dated Mar. 21, 2008 (7 pages).

Office Action issued Oct. 20, 2008, for U.S. Appl. No. 11/409,734, 30 pages.

International Preliminary Report on Patentability issued Oct. 22, 2008, for PCT Patent Application No. PCT/US2007/066991, 5 pages.

Search Report and Written Opinion for PCT/US07/66991 dated Aug. 27, 2008.

Office Action issued Dec. 1, 2008, for U.S. Appl. No. 11/407,848, 21 pages.

International Search Report and Written Opinion issued Feb. 19, 2009, for International Patent Application Serial No. PCT/US08/87318, 7 pages.

International Search Report and Written Opinion issued Feb. 27, 2009, for International Patent Application Serial No. PCT/IB07/04287, 6 pages.

International Preliminary Report on Patentability issued Mar. 5, 2009, for International Patent Application Serial No. PCT/US07/75743, 5 pages.

Chinese Office Action issued Feb. 27, 2009, for Chinese Patent Application Serial No. 200580016654.2, 6 pages.

Office Action issued Mar. 16, 2009, for U.S. Appl. No. 11/671,319, 47 pages.
International Preliminary Report on Patentability issued Mar. 26, 2009, for International Patent Application Serial No. PCT/US07/35052, 5 pages.
Office Action issued Apr. 14, 2009, for U.S. Appl. No. 11/409,734, 9 pages.
Office Action issued Jun. 22, 2009, for U.S. Appl. No. 11/852,295, 16 pages.
Examiner's Answer issued Jul. 28, 2009, for U.S. Appl. No. 11/407,848, 20 pages.
International Preliminary Report on Patentability issued Aug. 6, 2009, for International Patent Application Serial No. PCT/IB2007/004287, 5 pages.
Office Action issued Jul. 20, 2009, for U.S. Appl. No. 11/596,571, 19 pages.
International Preliminary Report on Patentability issued Aug. 20, 2009, for International Patent Application Serial No. PCT/US07/61703, 7 pages.
Examiner's Answer issued Aug. 21, 2009, for U.S. Appl. No. 11/466,022, 8 pages.
Office Action issued Oct. 27, 2009, for U.S. Appl. No. 11/407,848, 10 pages.
Office Action issued Nov. 12, 2009, for U.S. Appl. No. 11/409,734, 17 pages.
Russian Office Action issued Jan. 11, 2010, for Russian Patent Application Serial No. 2009113625, 2 pages.
English Translation of Russian Office Action issued Jan. 11, 2010, for Russian Patent Application Serial No. 2009113625, 2 pages.
Office Action issued Apr. 15, 2010, for U.S. Appl. No. 11/852,295, 7 pages.
Australian Examiner's Answer issued Mar. 31, 2010, for AU Patent Application Serial No. 2007315792, 1 page.
Office Action issued Mar. 11, 2010, for U.S. Appl. No. 11/596,571, 17 pages.
Office Action issued Mar. 24, 2010, for U.S. Appl. No. 11/958,466, 48 pages.
Office Action issued Jun. 16, 2010, for U.S. Appl. No. 12/016,600, 47 pages.
Office Action issued Jul. 28, 2010, for U.S. Appl. No. 11/958,466, 13 pages.
Wikipedia; "Drag (physics)", online encyclopedia, dated Jul. 8, 2010, 9 pages.
Australian Examiner's Report issued Nov. 5, 2009, for AU Patent Application Serial No. 2005248279, 2 pages.
Office Action issued Dec. 3, 2009, for U.S. Appl. No. 11/852,295, 10 pages.
Examiner's Answer issued Sep. 13, 2010, for U.S. Appl. No. 11/596,571, 20 pages.
Office Action issued Nov. 5, 2010, for U.S. Appl. No. 12/016,600, 10 pages.
Office Action issued Nov. 26, 2010, for U.S. Appl. No. 11/958,466, 14 pages.
Office Action issued Mar. 16, 2011, for U.S. Appl. No. 12/016,660, 8 pages.
Office Action issued Apr. 11, 2011, for U.S. Appl. No. 11/958,466, 9 pages.
Office Action issued Jun. 30, 2011 for U.S. Appl. No. 12/016,600, 13 pages.
Chinese Office Action issued Jul. 6, 2011 for CN Patent Application No. 200680055799.8, 7 pages.
Office Action issued Nov. 3, 2011 for U.S. Appl. No. 11/958,466, 11 pages.
Office Action issued Jan. 31, 2012 for U.S. Appl. No. 12/016,600, 8 pages.
Office Action issued Mar. 21, 2012 for U.S. Appl. No. 11/958,466, 9 pages.
China Office Action issued Apr. 6, 2012 for CN Patent Application No. 200780014027.4, 9 pages.
Office Action issued Apr. 9, 2012 for U.S. Appl. No. 13/303,477, 25 pages.
European Search Report issued Jun. 13, 2012 for EP Patent Application No. 07866607.0, 5 pages.
Office Action issued Jun. 28, 2012 for U.S. Appl. No. 11/958,466, 11 pages.
Office Action issued Jul. 3; 2012 for U.S. Appl. No. 12/016,600, 13 pages.
Office Action issued Sep. 10, 2012 for U.S. Appl. No. 13/303,477, 9 pages.
Advisory Action issued Sep. 14, 2012 for U.S. Appl. No. 12/016,600, 7 pages.
Office Action issued Nov. 6, 2012 for U.S. Appl. No. 12/016,600, 13 pages.
Office Action issued Nov. 19, 2012 for U.S. Appl. No. 11/958,466, 10 pages.
Advisory Action issued Dec. 10, 2012 for U.S. Appl. No. 13/303,477, 23 pages.
Chinese Official Action issued Dec. 11, 2012 for Chinese Patent Application No. 200780014027.4, 3 pages.
English translation of Chinese Official Action issued Dec. 11, 2012 for Chinese Patent Application No. 200780014027.4, 5 pages.
SPE 102208, "Means for Passive Inflow Control Upon Gas Breakthrough," dated Sep. 24-27, 2006.
SPE 25891, "Perforation Friction Pressure of Fracturing Fluid Slurries," dated Apr. 12-14, 1993.
U.S. Appl. No. 11/409,734, filed Apr. 24, 2006.
U.S. Appl. No. 11/466,022, filed Aug. 21, 2006.
U.S. Appl. No. 11/668,024, filed Jan. 29, 2007.
U.S. Appl. No. 11/407,848, filed Apr. 20, 2006.
U.S. Appl. No. 11/502,074, filed Aug. 10, 2006.
U.S. Appl. No. 11/702,312, filed Feb. 5, 2007.
International Search Report for PCT/NO02/00158, Aug. 28, 2002.

* cited by examiner

WELL TOOLS WITH ACTUATORS UTILIZING SWELLABLE MATERIALS

BACKGROUND

The present invention relates generally to equipment utilized and operations performed in conjunction with subterranean wells and, in embodiments described herein, more particularly provides well tools with actuators utilizing swellable materials.

Many well tools are commercially available which are actuated by manipulation of a tubular string from the surface. Packers, liner hangers, jars, etc. are some examples of these. Other well tools may be actuated by intervention into a well, such as by using a wireline, slickline, coiled tubing, etc. Still other well tools may be actuated utilizing lines extending to the surface, such as electrical, hydraulic, fiber optic and other types of lines. Telemetry-controlled well tools are also available which are actuated in response to electromagnetic, acoustic, pressure pulse and other forms of telemetry.

However, each of these actuation methods has its drawbacks. Manipulation of tubular strings from the surface is time-consuming and labor-intensive, and many well operations cannot be performed during manipulation of a tubing string. Intervention into a well with wireline, slickline, coiled tubing, etc., typically obstructs the wellbore, impedes flow, requires a through-bore for the intervention, requires specialized equipment and presents other difficulties. Electrical, hydraulic and fiber optic lines are relatively easily damaged and require special procedures and equipment during installation. Telemetry requires expensive sophisticated signal transmitting, receiving and processing equipment and is limited by factors such as distance, noise, etc.

It will, thus, be readily appreciated that improvements are needed in the art of actuating well tools.

SUMMARY

In carrying out the principles of the present invention, well tool actuation devices and methods are provided which solve at least one problem in the art. One example is described below in which a swellable material is utilized in an actuator for a well tool. Another example is described below in which a swellable material applies a biasing force to cause displacement of a member of a well tool actuator.

In one aspect of the invention, a unique well tool is provided. The well tool includes an actuator which actuates the well tool in response to contact between a swellable material and a well fluid.

In another aspect of the invention, a method of actuating a well tool is provided. The method includes the steps of: installing the well tool including an actuator; contacting a swellable material of the actuator with a well fluid; and actuating the well tool in response to the contacting step.

In yet another aspect of the invention, a well system includes a well tool having a flow control device and a swellable material. The well tool is operative to control flow through a passage of a tubular string in response to contact between the swellable material and well fluid.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
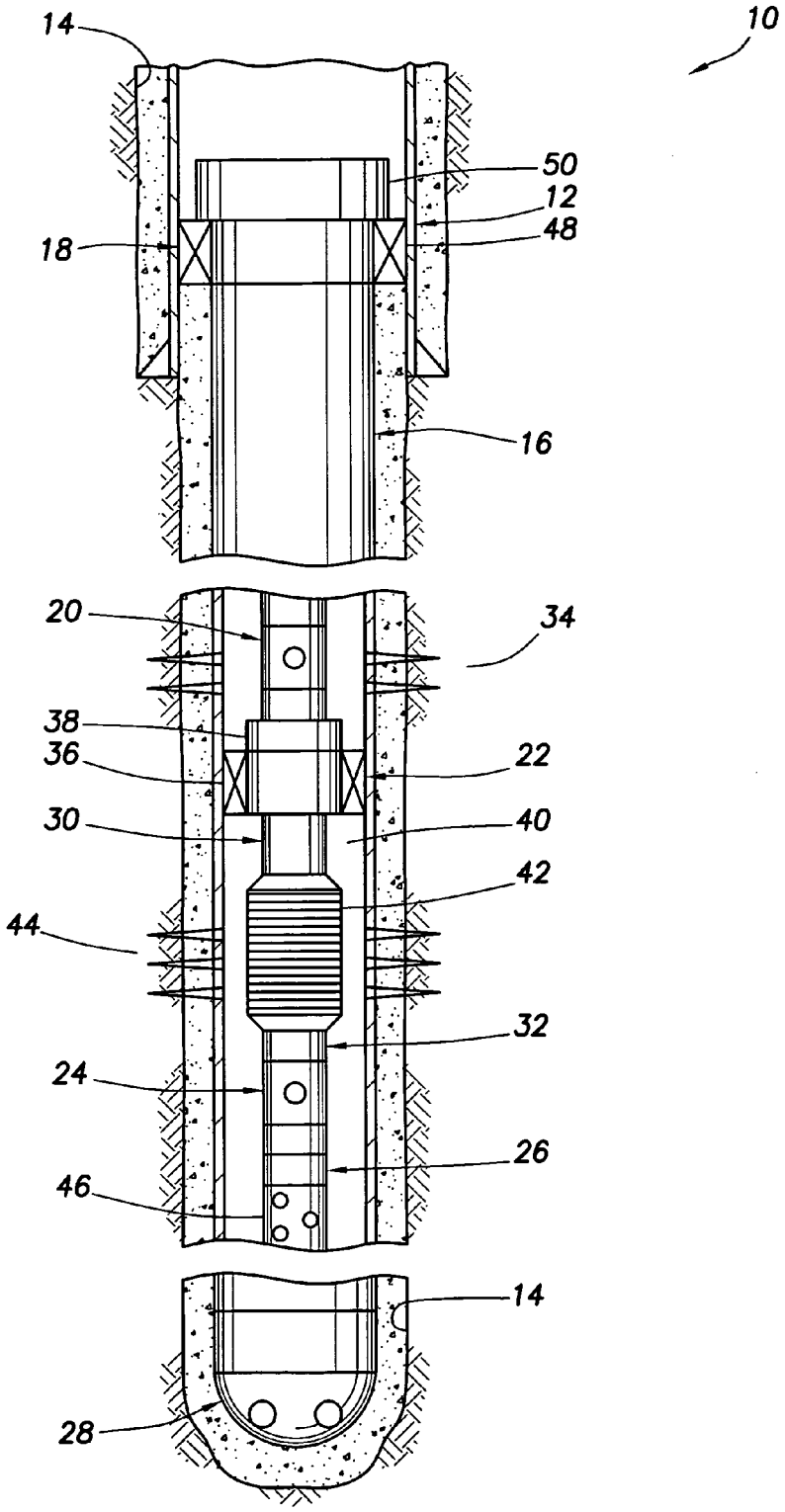
FIG. 1 is a schematic partially cross-sectional view of a well system embodying principles of the present invention.

Representatively illustrated in FIG. 1 are a well system 10 and associated methods which embody principles of the present invention. The well system 10 includes a casing string or other type of tubular string 12 installed in a wellbore 14. A liner string or other type of tubular string 16 has been secured to the tubular string 12 by use of a liner hanger or other type of well tool 18.

The well tool 18 includes an anchoring device 48 and an actuator 50. The actuator 50 sets the anchoring device 48, so that the tubular string 16 is secured to the tubular string 12. The well tool 18 may also include a sealing device (such as the sealing device 36 described below) for sealing between the tubular strings 12, 16 if desired.

The well tool 18 is one example of a wide variety of well tools which may incorporate principles of the invention. Other types of well tools which may incorporate the principles of the invention are described below. However, it should be clearly understood that the invention is not limited to use only with the well tools described herein, and these well tools may be used in other well systems and in other methods without departing from the principles of the invention.

In addition to the well tool 18, the well system 10 includes well tools 20, 22, 24, 26, 28 and 30. The well tool 20 includes a flow control device (for example, a valve or choke, etc.) for controlling flow between an interior and exterior of a tubular string 32. As depicted in FIG. 1, the well tool 20 also controls flow between the interior of the tubular string 32 and a formation or zone 34 intersected by an extension of the wellbore 14.

The well tool 22 is of the type known to those skilled in the art as a packer. The well tool 22 includes a sealing device 36 and an actuator 38 for setting the sealing device, so that it prevents flow through an annulus 40 formed between the tubular strings 16, 32. The well tool 22 may also include an anchoring device (such as the anchoring device 48 described above) for securing the tubular string 32 to the tubular string 16 if desired.

The well tool 24 includes a flow control device (for example, a valve or choke, etc.) for controlling flow between the annulus 40 and the interior of the tubular string 32. As depicted in FIG. 1, the well tool 24 is positioned with a well screen assembly 42 in the wellbore 14. Preferably, the flow control device of the well tool 24 allows the tubular string 32 to fill as it is lowered into the well (so that the flow does not have to pass through the screen assembly 42, which might damage or clog the screen) and then, after installation, the flow control device closes (so that the flow of fluid from a zone 44 intersected by the wellbore 14 to the interior of the tubular string is filtered by the screen assembly).

The well tool 26 is of the type known to those skilled in the art as a firing head. The well tool 26 is used to detonate perforating guns 46. Preferably, the well tool 26 includes features which prevent the perforating guns 46 from being detonated until they have been safely installed in the well.

The well tool 28 is of the type known to those skilled in the art as a cementing shoe or cementing valve. Preferably, the well tool 28 allows the tubular string 16 to fill with fluid as it is being installed in the well, and then, after installation but prior to cementing the tubular string in the well, the well tool permits only one-way flow (for example, in the manner of a check valve).

The well tool 30 is of the type known to those skilled in the art as a formation isolation valve or fluid loss control valve. Preferably, the well tool 30 prevents downwardly directed flow (as viewed in FIG. 1) through an interior flow passage of the tubular string 32, for example, to prevent loss of well fluid to the zone 44 during completion operations. Eventually, the well tool 30 is actuated to permit downwardly directed flow (for example, to allow unrestricted access or flow therethrough).

Although only the actuators 38, 50 have been described above for actuating the well tools 18, 22, it should be understood that any of the other well tools 20, 24, 26, 28, 30 may also include actuators. However, it is not necessary for any of the well tools 18, 20, 22, 24, 26, 28, 30 to include a separate actuator in keeping with the principles of the invention.

Figure 2A:
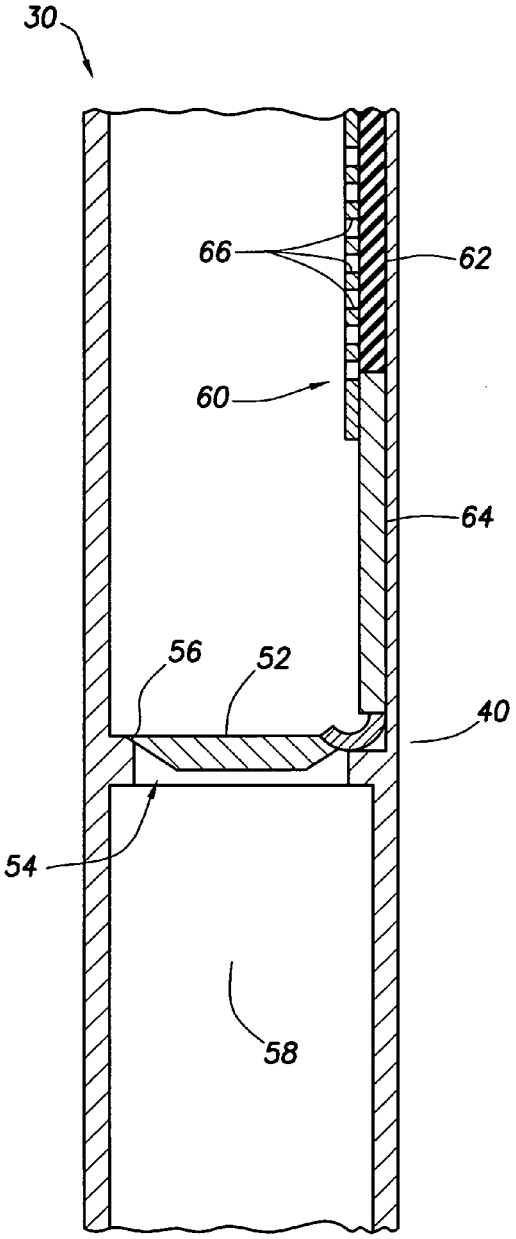
FIGS. 2A & B are schematic cross-sectional views of a first well tool which may be used in the system of FIG. 1.

Referring additionally now to FIGS. 2A & B, an enlarged scale schematic cross-sectional view of the well tool 30 is representatively illustrated, apart from the remainder of the well system 10. The well tool 30 is depicted in FIG. 2A in a configuration in which the well tool is initially installed in the well, and in FIG. 2B the well tool is depicted in a configuration in which the well tool has been actuated in the well.

The well tool 30 includes a flow control device 54 in the form of a flapper or other type of closure member 52 which engages a seat 56 to prevent downward flow through a flow passage 58. When used in the well system 10, the flow passage 58 would extend through the interior of the tubular string 32.

Instead of the flapper closure member 52, the flow control device 54 could include a ball closure (for example, of the type used in subsea test trees or safety valves), a variable flow choking mechanism or any other type of flow control. In addition, it should be understood that it is not necessary for the well tool 30 to permit one-way flow through the passage 58, either when the well tool is initially installed in the well, or when the well tool is subsequently actuated.

Figure 2B:
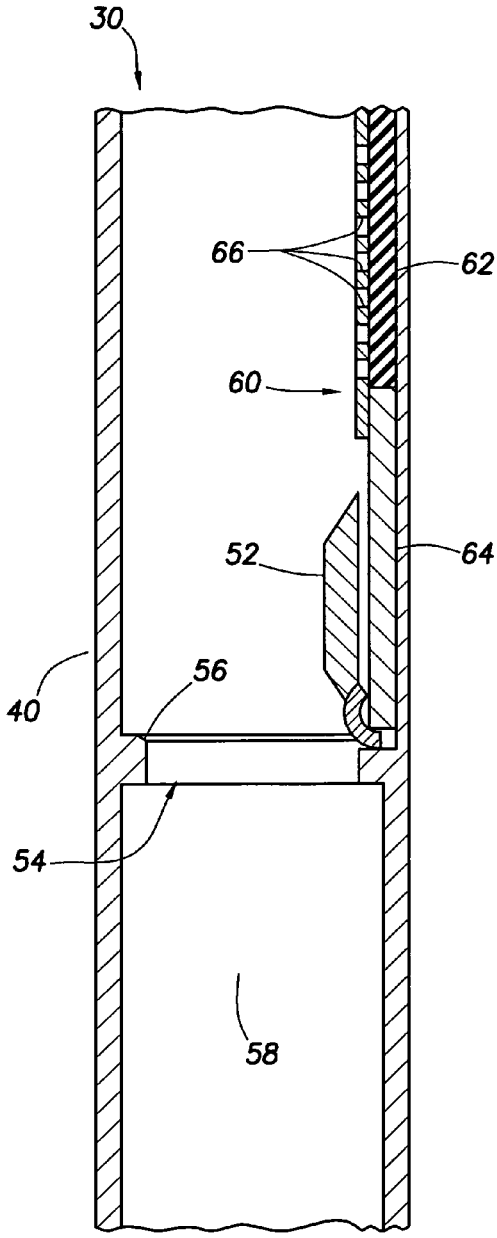

The well tool 30 also includes an actuator 60 for actuating the flow control device 54. The actuator 60 includes a swellable material 62 and an elongated member 64. Displacement of the actuator member 64 in a downward direction causes the closure member 52 to pivot upwardly and disengage from the seat 56, thereby permitting downward flow of fluid through the passage 58 (as depicted in FIG. 2B).

The swellable material 62 swells (increases in volume) when contacted with a certain fluid in the well. For example, the material 62 could swell in response to contact with water, in response to contact with hydrocarbon fluid, or in response to contact with gas in the well, etc. Ports 66 may be provided in the actuator 60 to increase a surface area of the material 62 exposed to the fluid in the well.

Examples of swellable materials are described in U.S. patent application publication nos. 2004-0020662, 2005-0110217, 2004-0112609, and 2004-0060706, the entire disclosures of which are incorporated herein by this reference. Other examples of swellable materials are described in PCT patent application publication nos. WO 2004/057715 and WO 2005/116394.

When contacted by the appropriate fluid for a sufficient amount of time (which may be some time after installation of the well tool 30 in the well), the material 62 increases in volume and applies a downwardly directed biasing force to the actuator member 64. This causes the member 64 to displace downward and thereby pivot the closure member 52 upward.

Other mechanisms and devices may be present in the well tool 30 although they are riot depicted in FIGS. 2A & B for clarity of illustration and description. For example, the flow control device 54 could include a spring or other biasing mechanism for maintaining the closure member 52 in sealing engagement with the seat 56 prior to the actuator 60 causing the closure member to pivot upward.

The ports 66 are depicted as providing for contact between the material 62 and fluid in the passage 58. However, it will be appreciated that the ports 66 could be positioned to alternatively, or in addition, provide for contact between the material 62 and fluid in the annulus 40 on the exterior of the well tool 30 (similar to the ports 82 described below and depicted in FIGS. 3A & B).

The fluid (e.g., hydrocarbon liquid, water, gas, etc.) which contacts the material 62 to cause it to swell may be introduced at any time. The fluid could be in the well at the time the well tool 30 is installed in the well. The fluid could be flowed into the well after installation of the well tool 30. For example, if the fluid is hydrocarbon fluid, then the fluid may contact the material 62 after the well is placed in production.

Figure 3A:
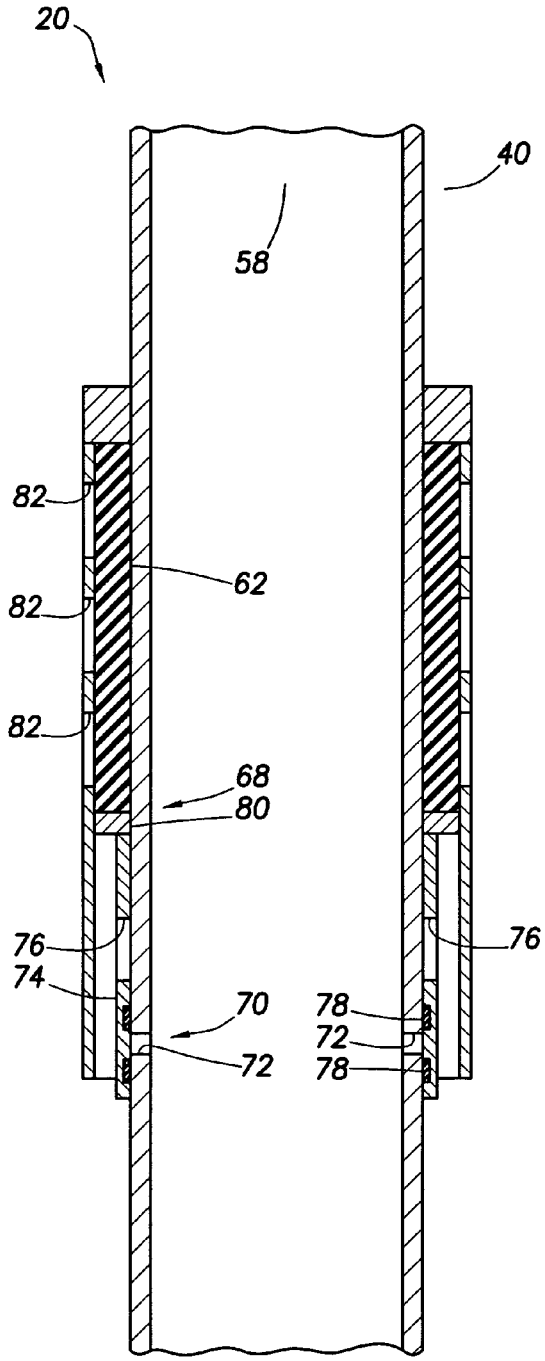
FIGS. 3A & B are schematic cross-sectional views of a second well tool which may be used in the system of FIG. 1.

Referring additionally now to FIGS. 3A & B, an enlarged scale schematic cross-sectional view of the well tool 20 is representatively illustrated, apart from the remainder of the well system 10. The well tool 20 is depicted in FIG. 3A in a configuration in which the well tool is initially installed in the well, and in FIG. 3B in a configuration in which the well tool has been actuated in the well.

The well tool 20 includes the swellable material 62 in an actuator 68 for a flow control device 70. The actuator 68 and flow control device 70 are similar in some respects to the actuator 60 and flow control device 54 of the well tool 30 as described above.

However, the flow control device 70 is used to selectively control flow through flow passages 72 and thereby control flow between the exterior and interior of the tubular string 32. For this purpose, the flow control device 70 includes a sleeve 74 having openings 76 and seals 78.

Figure 3B:
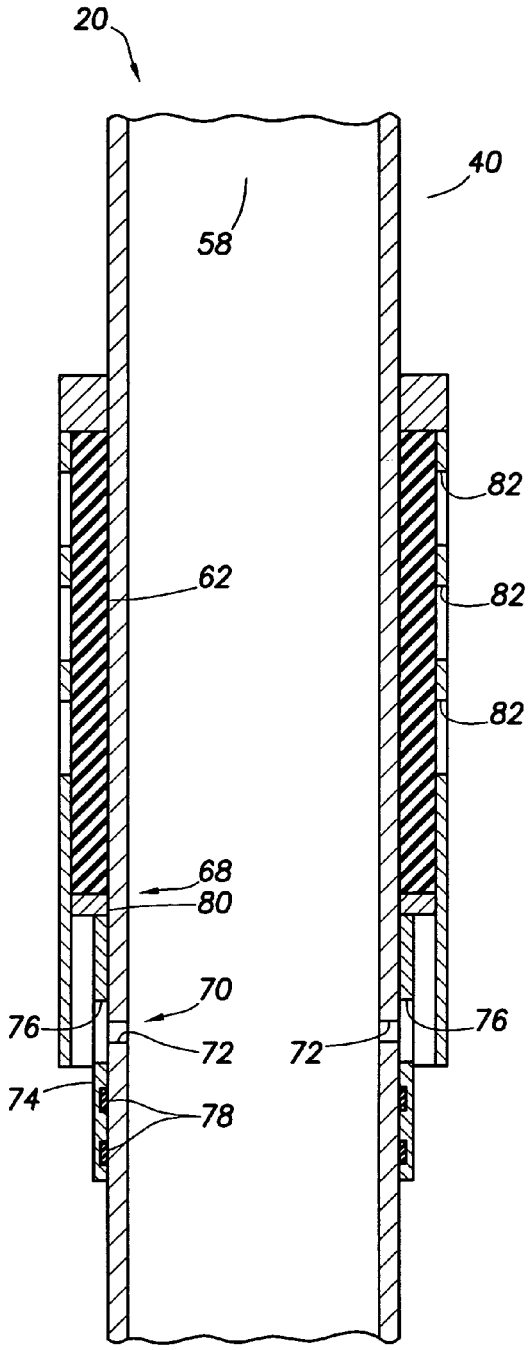

As depicted in FIG. 3B, the openings 76 are aligned with the passages 72, and so flow between the interior and exterior of the tubular string 32 (or between the passage 58 and annulus 40) is permitted. As depicted in FIG. 3A, the openings 76 are not aligned with the passages 72, but instead the seals 78 straddle the passages and prevent flow between the interior and exterior of the tubular string 32.

The actuator 68 includes a member 80 which is displaced when the material 62 swells. Note that the member 80 and the sleeve 74 may be integrally formed or otherwise constructed to perform their respective functions.

The actuator 68 also includes ports 82 which provide for contact between the material 62 and fluid in the annulus 40 exterior to the tubular string 32. Note that the ports 82 could alternatively, or in addition, be positioned to provide for contact between the material 62 and fluid in the passage 58 on the interior of the tubular string 32 (similar to the ports 66 described above).

The fluid (e.g., hydrocarbon liquid, water, gas, etc.) which contacts the material 62 to cause it to swell may be introduced at any time. The fluid could be in the well at the time the well tool 20 is installed in the well. The fluid could be flowed into the well after installation of the well tool 20. For example, if the fluid is hydrocarbon fluid, then the fluid may contact the material 62 after the well is placed in production.

Although the well tool 20 is described above as being opened after installation in the well and after contact with an appropriate fluid for a sufficient amount of time to swell the material 62, it will be readily appreciated that the well tool could be readily modified to instead close after installation in the well. For example, the relative positions of the openings 76 and seals 78 on the sleeve 74 could be reversed while the position of the ports 70 could be such that they initially align with the openings, and then are sealed off after the swelling of the material 62.

Figure 4A:
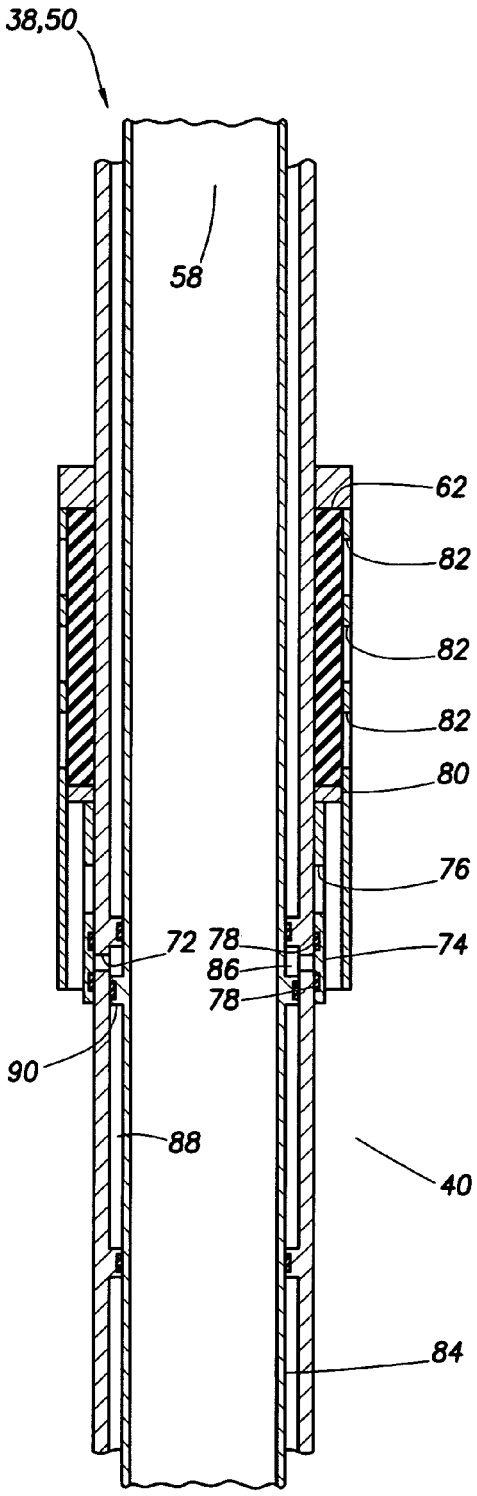
FIGS. 4A & B are schematic cross-sectional views of an actuator for a third well tool which may be used in the system of FIG. 1.

Referring additionally now to FIGS. 4A & B, a schematic cross-sectional view of an actuator which may be used for the actuators 38, 50 in the well system 10 is representatively illustrated. The actuator is depicted in FIG. 4A in a configuration in which the actuator is initially installed in the well, and in FIG. 4B the actuator is depicted in a configuration in which the actuator has been used to actuate a device (such as the anchoring device 48 of the well tool 18 or the sealing device 36 of the well tool 22). However, it should be clearly understood that the actuator depicted in FIGS. 4A & B could be used to operate other types of devices and may be used in other types of well tools, in keeping with the principles of the invention.

Those skilled in the art will appreciate that a conventional method of setting a packer or liner hanger is to apply an upwardly or downwardly directed force to a mandrel assembly of the packer or liner hanger. In FIGS. 4A & B, a portion of a mandrel assembly 84 is depicted as being included in the actuator 38, 50. This mandrel assembly 84 is displaced downwardly after installation in the well to set the sealing device 36 or anchoring device 48. However, it will be appreciated that the mandrel assembly 84 could instead be displaced upwardly, or in any other direction, to actuate a well tool without departing from the principles of the invention.

Some portions of the actuator 38, 50 are similar to those of the actuator 68 described above, and these are indicated in FIGS. 4A & B using the same reference numbers. Specifically, the swellable material 62 is used to displace the member 80 and sleeve 74 relative to the passage 72.

In the embodiment of FIGS. 4A & B, however, the passage 72 is in communication with a chamber 86 which is initially at a relatively low pressure (such as atmospheric pressure). Another chamber 88 is provided which is initially at a relatively low pressure, with a piston 90 on the mandrel assembly 84 separating the chambers 86, 88.

Figure 4B:
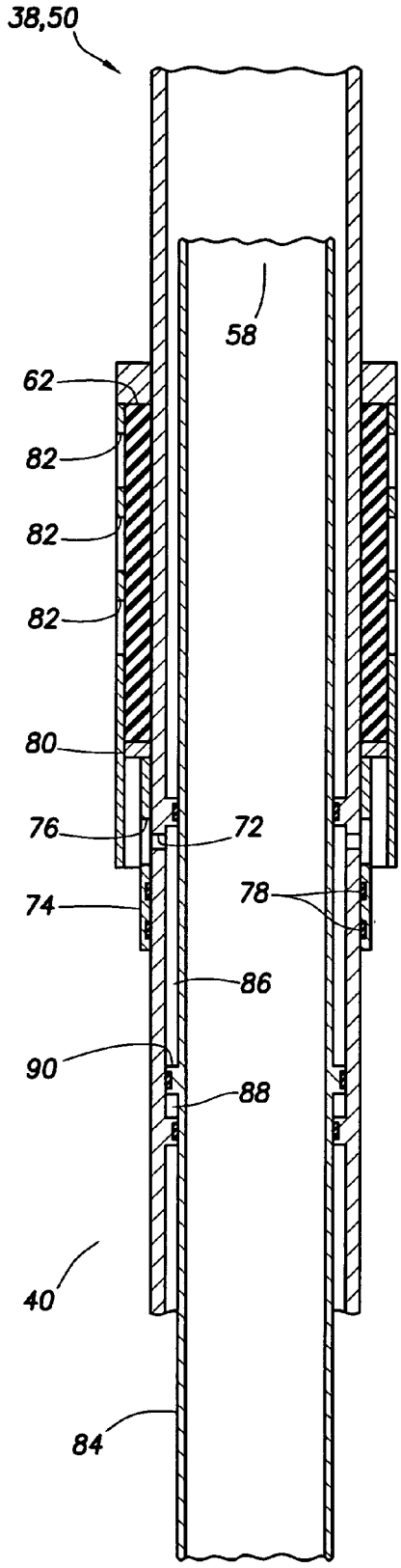

As depicted in FIG. 4A, pressures across the piston 90 are initially balanced and there is no biasing force thus applied to the mandrel assembly 84. However, when the material 62 swells and the sleeve 74 is displaced downwardly as depicted in FIG. 4B, the openings 76 align with the passages 72 and the relatively high pressure in the annulus 40 enters the chamber 86. A pressure differential across the piston 90 results, and the mandrel assembly 84 is thereby biased to displace downwardly, setting the anchoring device 48 and/or sealing device 36.

Figure 5B:
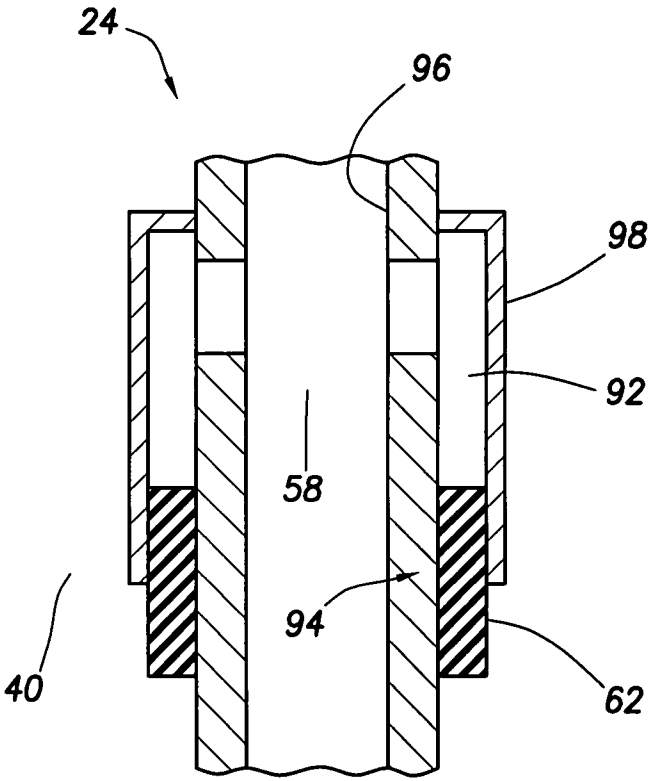
FIGS. 5A & B are schematic cross-sectional views of a fourth well tool which may be used in the system of FIG. 1.
Figure 5A:
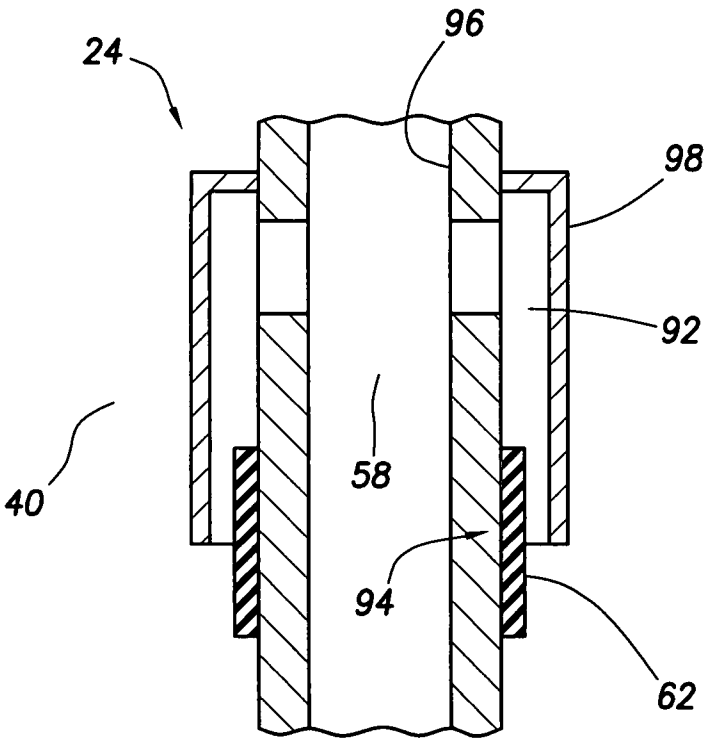

Referring additionally now to FIGS. 5A & B, schematic cross-sectional views of the well tool 24 are representatively illustrated. The well tool 24 is depicted in FIG. 5A in a configuration in which the well tool is initially installed in the well, and in FIG. 5B the well tool is depicted after installation.

The well tool 24 includes the swellable material 62 described above. However, in this embodiment, the material 62 is not used in a separate actuator for the well tool 24. Instead, the material 62 itself is used to directly seal off a flow passage 92 which provides for fluid communication between the passage 58 and the annulus 40 (or between the interior and exterior of the tubular string 32).

The material 62 and passage 92 are included in a flow control device 94 of the well tool 24. As depicted in FIG. 5A, the flow passage 92 is open and permits flow between the passage 58 and the annulus 40. As depicted in FIG. 5B, the flow passage 92 has been closed off due to the increased volume of the material 62 and its resulting sealing engagement between inner and outer housings 96, 98 of the well tool 24.

Figure 6B:
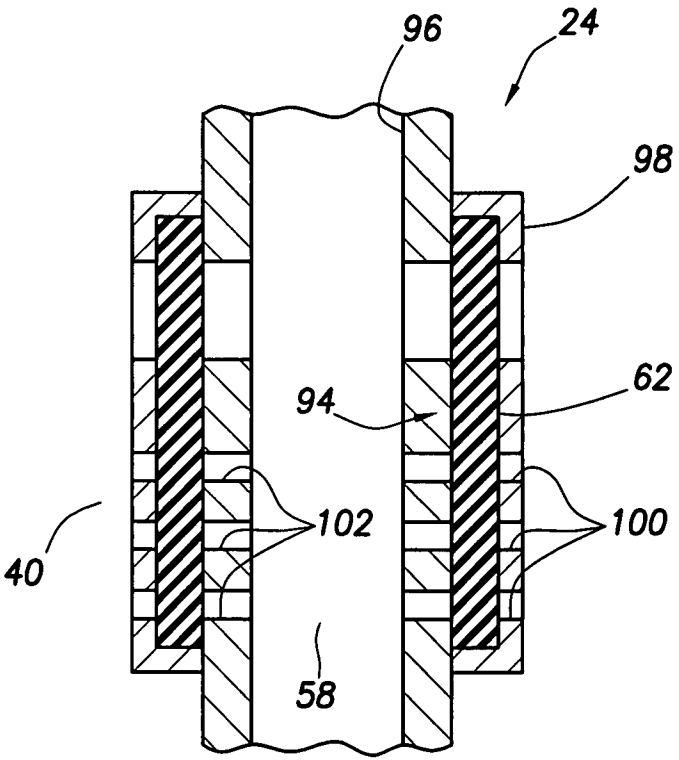
FIGS. 6A & B are schematic cross-sectional views of an alternate construction of the fourth well tool.
Figure 6A:
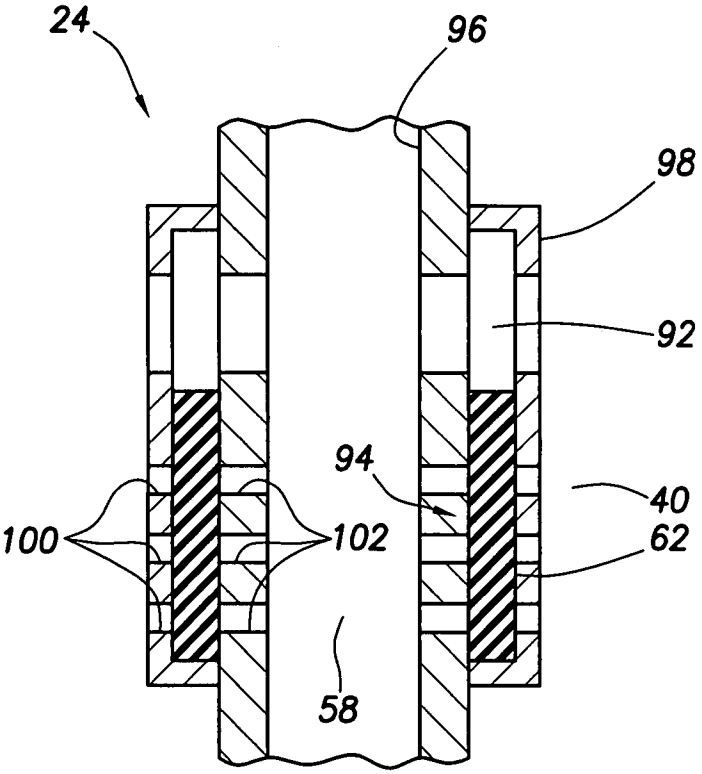

Referring additionally now to FIGS. 6A & B, an alternate construction of the well tool 24 is representatively illustrated. In this alternate construction, the material 62 does not necessarily seal between the inner and outer housings 96, 98, but when the material swells it does at least block flow through the passage 92.

Note that in this embodiment, ports 100 provide for contact between the material 62 and fluid in the annulus 40, and ports 102 provide for contact between the material 62 and fluid in the passage 58. Either or both of these sets of ports 100, 102 may be used as desired.

It will be appreciated that the well tool 24 as depicted in either FIGS. 5A & B or in FIGS. 6A & B may be substituted for the well tool 20 as depicted in FIGS. 3A & B, and vice versa. In addition, any of the flow control devices described above may be fairly easily converted to open instead of close after installation in the well, and any of the flow control devices may be used in the well tools 26, 28 if desired.

Referring again to FIG. 1, in one unique method of using the well tool 20, a well testing operation may be conducted using the features of the well tool. For example, flow between the zone 34 and the interior of the tubular string 32 may be initially permitted, thereby allowing for testing of the zone (for example, flow testing, build-up and drawdown tests, etc.).

After sufficient contact between the material 62 and fluid in the well, the flow control device 70 will close and prevent flow between the zone 34 and the interior passage 58 of the tubular string 32, thereby isolating the zone. Subsequent tests may then be performed on another zone (such as the zone 44) which is in fluid communication with the interior of the tubular string 32, without interference due to fluid communication with the zone 34.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A well tool, comprising:

an actuator which actuates the well tool in response to contact between a swellable material and a selected fluid;

a passage for fluid flow in the well tool; and a closure member which is displaceable to selectively permit and prevent fluid flow through the passage, and wherein the closure member pivots in a direction opposite to a direction in which the swellable material swells when contacted with the selected fluid.

2. The well tool of claim 1, wherein the swellable material increases in volume in response to the contact between the swellable material and the selected fluid.

3. The well tool of claim 1, wherein the swellable material displaces an actuator member of the actuator in response to the contact between the swellable material and the selected fluid.

4. The well tool of claim 1, wherein the swellable material applies a biasing force to an actuator member of the actuator in response to the contact between the swellable material and the selected fluid.

* * * * *